United States Patent [19]

Walker

[11] 4,161,901

[45] Jul. 24, 1979

[54] DYNAMICALLY ADAPTIVE PLAYER PIANO ROLL TO MAGNETIC TAPE FORMATING SYSTEM AND PLAYBACK

[75] Inventor: Henry V. Walker, Franklin, Tenn.

[73] Assignee: Teledyne Industries, Inc., Los Angeles, Calif.

[21] Appl. No.: 792,847

[22] Filed: May 2, 1977

[51] Int. Cl.[2] ..... G10F 5/00; G10G 3/04

[52] U.S. Cl. ..... 84/115; 84/1.03; 84/DIG. 29

[58] Field of Search ..... 84/1.01–1.03, 84/1.09, 1.1, 1.24, 1.27, 1.28, 115, DIG. 29, 33, 39, 462

[56] References Cited

U.S. PATENT DOCUMENTS

| | | | |
|---|---|---|---|
| 1,639,105 | 8/1927 | Perron | 84/33 |
| 1,749,413 | 3/1930 | Cheek | 84/39 X |
| 1,827,814 | 10/1931 | Holmgren | 84/39 |
| 3,604,299 | 9/1971 | Englund | 84/1.03 |
| 3,683,096 | 8/1972 | Peterson et al. | 84/115 |
| 3,789,719 | 2/1974 | Maillet | 84/115 |
| 3,872,766 | 3/1975 | Fukui | 84/115 |
| 4,023,456 | 5/1977 | Groeschel | 84/115 |

*Primary Examiner*—Stanley J. Witkowski
*Attorney, Agent, or Firm*—Jim Zegeer

[57] ABSTRACT

There is disclosed an electronically adaptive player piano roll to magnetic tape formatting system which adapts itself to play the expression music generated from different sources. A plurality of control bits are inserted into vacant or unused bit positions of a prior art time division multiplex frame of musical data encoded, preferably, in a bi-phase mark/space code. The control bits identify the particular type of player piano roll music which has been well known in the prior art, such as a Welte, Ampico or Duo-Art, each of which have different manners of expression for reproducing the playing style of the original artist. During the playback, a circuit is provided for recognizing the control bits and decoding same and automatically varying the split between the bass and treble expression points of the particular source, whether it be the Welte roll, the Duo-Art roll, or the Ampico roll, or any other roll provided the code has been entered during the time the roll is being formatted into the word or frame of the time division multiplexed musical data.

9 Claims, 8 Drawing Figures

BIT ASSIGNMENT

| | | | | | |
|---|---|---|---|---|---|
| 1. | $C\#_{16}$ | 44. | G# | 87. | $B_{32}$ |
| 2. | D | 45. | A | 88. | $C_{16}$ |
| 3. | D# | 46. | A# | 89. | |
| 4. | E | 47. | B | 90. | |
| 5. | F | 48. | C | 91. | |
| 6. | F# | 49. | C# | 92. | 0 |
| 7. | G | 50. | D | 93. | |
| 8. | G# | 51. | D# | 94. | |
| 9. | A | 52. | E | 95. | |
| 10. | A# | 53. | F | 96. | |
| 11. | B | 54. | F# | 97. | |
| 12. | C | 55. | G | 98. | 0 |
| 13. | C# | 56. | G# | 99. | |
| 14. | D | 57. | A | 100. | |
| 15. | D# | 58. | A# | 101. | |
| 16. | E | 59. | B | 102. | |
| 17. | F | 60. | C | 103. | |
| 18. | F# | 61. | C# | 104. | 0 |
| 19. | G | 62. | D | 105. | BASS THEME |
| 20. | G# | 63. | D# | 106. | BASS INTENSITY 1 |
| 21. | A | 64. | E | 107. | BASS INTENSITY 2 |
| 22. | A# | 65. | F | 108. | BASS INTENSITY 3 |
| 23. | B | 66. | F# | 109. | BASS INTENSITY 4 |
| 24. | C | 67. | G | 110. | 0 |
| 25. | C# | 68. | G# | 111. | TREBLE THEME |
| 26. | D | 69. | A | 112. | TREBLE INTENSITY 1 |
| 27. | D# | 70. | A# | 113. | TREBLE INTENSITY 2 |
| 28. | E | 71. | B | 114. | TREBLE INTENSITY 3 |
| 29. | F | 72. | C | 115. | TREBLE INTENSITY 4 |
| 30. | F# | 73. | C# | 116. | 0 |
| 31. | G | 74. | D | 117. | SUSTAIN PEDAL |
| 32. | G# | 75. | D# | 118. | SOFT PEDAL |
| 33. | A | 76. | E | 119. | CODE WORD BITS |
| 34. | A# | 77. | F | 120. | |
| 35. | B | 78. | F# | 121. | 1 |
| 36. | C (MIDDLE) | 79. | G | 122. | 1 |
| 37. | C# | 80. | G# | 123. | 1 |
| 38. | D | 81. | A | 124. | 1 |
| 39. | D# | 82. | A# | 125. | 1 SYNC |
| 40. | E | 83. | B | 126. | 1 |
| 41. | F | 84. | C | 127. | 0 |
| 42. | F# | 85. | $A_{32}$ | 128. | 1 |
| 43. | G | 86. | $A\#_{32}$ | | |

(14 UNASSIGNED BITS)

FIG. 2a

| INPUTS | | OUTPUTS | |
|---|---|---|---|
| A | B | 3 | 4 |
| 0 | 0 | 2 | 1 |
| 0 | 1 | 1 | 1 |
| 1 | 0 | 2 | 2 |
| 1 | 1 | 1 | 2 |

TRUTH TABLE FOR LOGIC CIRCUIT SHOWN IN FIG. 5

DYNAMICALLY ADAPTIVE PLAYER PIANO ROLL TO MAGNETIC TAPE FORMATING SYSTEM AND PLAYBACK

RELATED APPLICATIONS

This invention is related to the subject matter disclosed in U.S. Ser. No. 681,093, filed Apr. 28, 1976 for "Method and Apparatus for Reproducing a Musical Presentation" of Joseph Max Campbell; U.S. Ser. No. 681,098, filed Apr. 28, 1976 for "Demultiplex and Storage System for Time Division Multiplexed Frames of Musical Data" of William Solon Finley; U.S. Ser. No. 680,996, filed Apr. 28, 1976 for "Solenoid-Hammer Control System for the Re-Creation of Expression Effects From a Recorded Musical Presentation" of Joseph Max Campbell and William Solon Finley, all assigned to the assignee hereof.

BACKGROUND OF THE INVENTION

This invention related to electronic musical instruments using time division multiplex signal trains for carrying musical data to re-create a performance that has been previously recorded on paper rolls, metal rolls, discs, etc. and, more especially, the so-called reproducing piano. Of these, a number gained widespread fame in the art, such as the Welte Mignon which, by means of a special recording device, the exact playing technique of famous artists could be captured on a paper roll. By means of sophisticated expression devices, the Welte Mignon piano could re-enact every moment, every nuance and every tonal shading of the performing artist (see PTM Magazine of February, 1969). Two American made types, the Ampico and the Duo-Art dominated the market in the United States and hence, there is a large number of roll music for these instruments in existence and some collectors have vast libraries of such recorded music. However, in each of the expression devices it is necessary to split the bass and treble expresion points so as to play expression music generated from these different sources. One source, the Welte, requires the split to be between notes 43 and 44, another, the Duo-Art, requires the split to be between 44 and 45, and still another, the Ampico, requires the split to be between notes 46 and 47. Thus, the problem solved by the present invention is to provide an electronic system which will recognize which of the sources is being played and automatically adapt the playback system of an electronic player piano to accommodate all of these various sources without difficulty. The invention is incorporated into a prior art electronic player piano system of the type disclosed in the above-identified applications as well as in the "Service Manual" for Teledyne Piano Recorder/Player Model PP-1, Assembly No. 3288" ATL 3263, a publication of the assignee hereof, published in October, 1975.

BRIEF DESCRIPTION OF THE DRAWINGS

The above and other objects, advantages, and features of the invention will become more apparent when considered with the following specification and accompanying drawings wherein.

FIG. *2a* is a bit (or data cell) assignment chart, for each frame of multiplexed data and FIG. *2b* is a diagrammatic illustration of a magnetic tape showing the serial sequence of frames of data, each frame being as per the bit or data cell assignments shown in FIG. *2a;*

Figure 3:
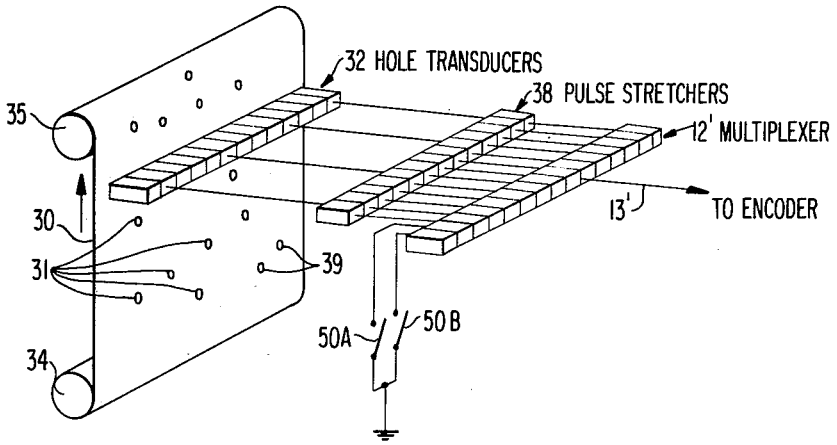
Figure 4:
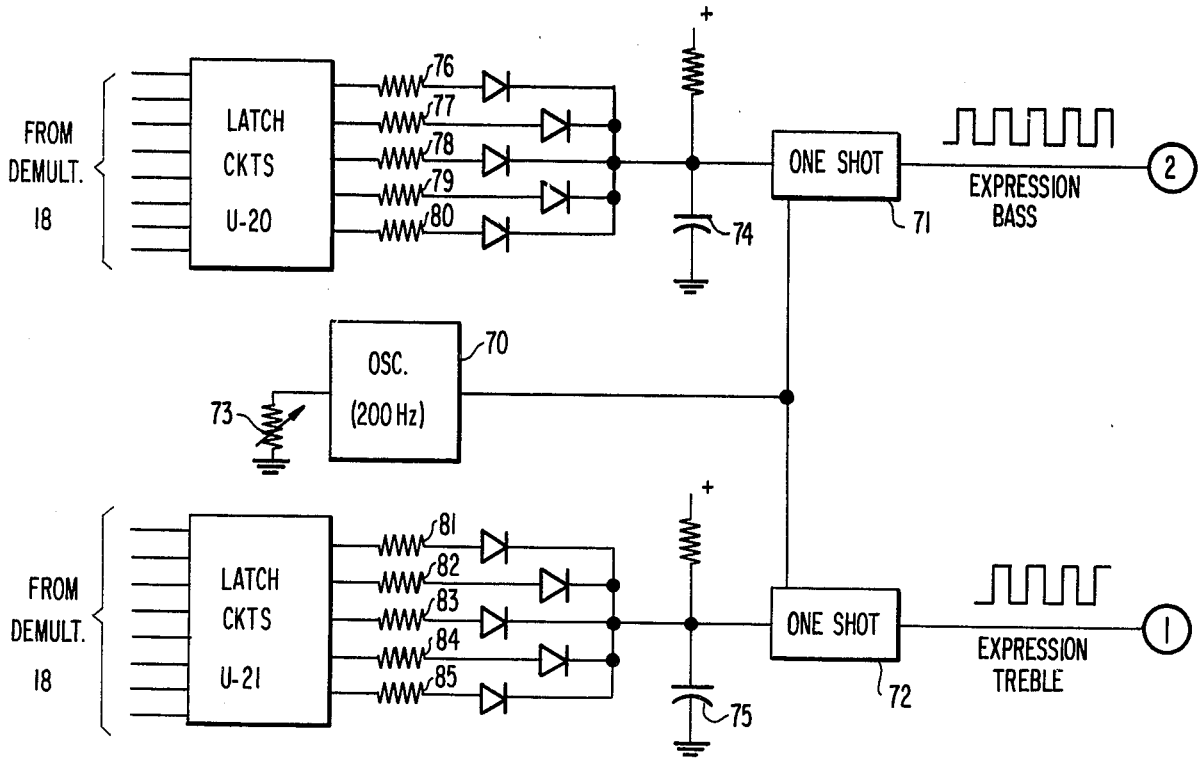
FIG 4 (PRIOR ART)
Figure 5:
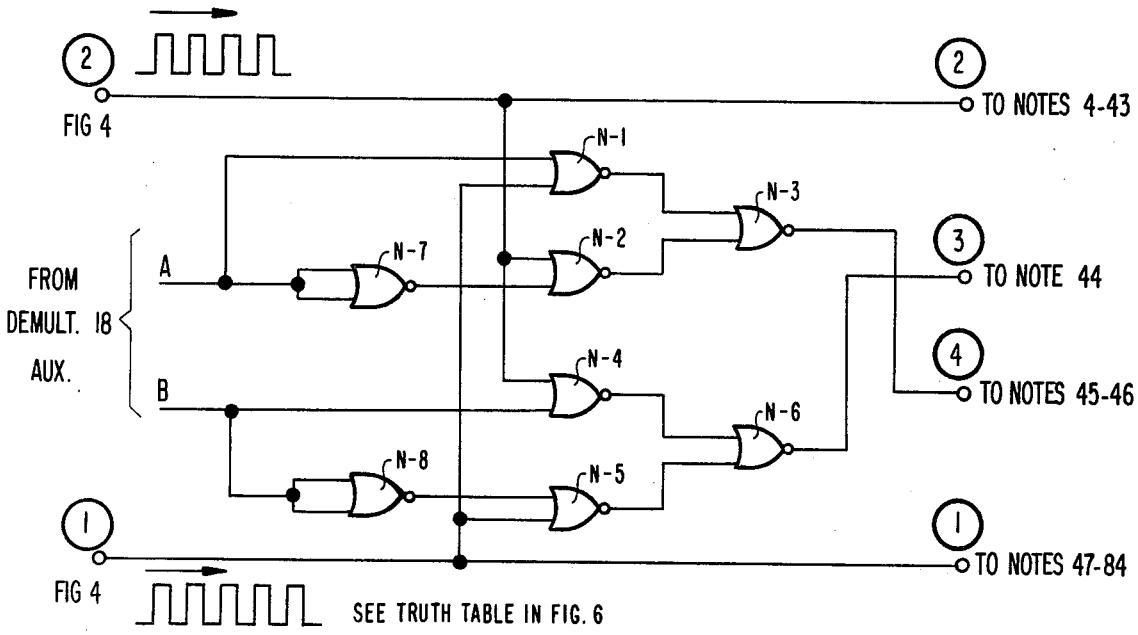
Figures 6, 7:
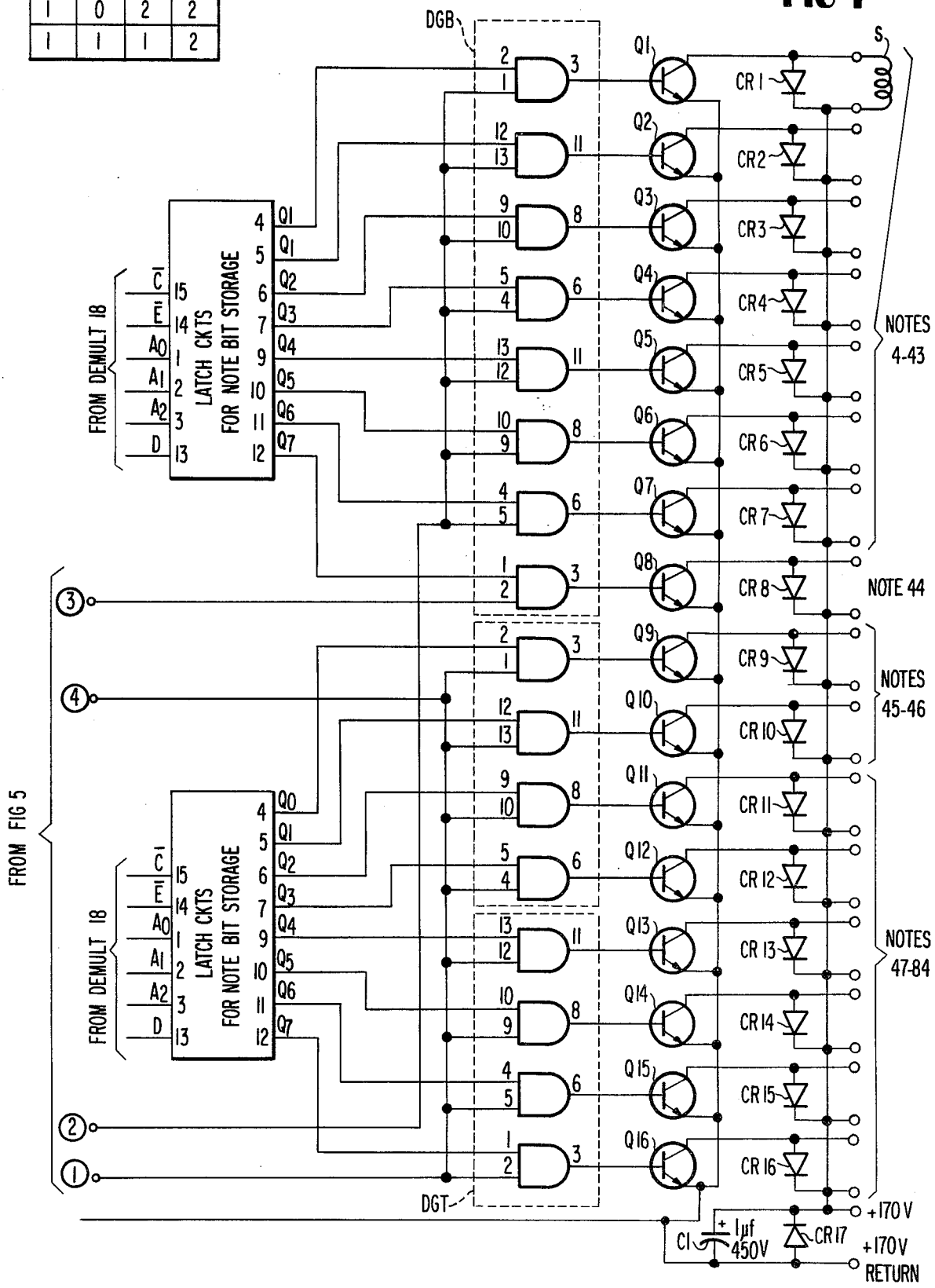

FIG. 3 is a diagrammatic perspective view of a roll to tape transcriber system as incorporated in the invention, showing the means for entering the source code signals;

FIG. 4 is a diagrammatic portion of the expression recovery circuit of the prior art to show the connection of the present invention therewith;

FIG. 5 is a logic diagram for decoding the source code signals and controlling the expression split point;

FIG. 6 is the truth table for the logic system of FIG. 5, and

FIG. 7 shows the playback driver circuit of the prior art as modified to show the connection of the invention therewith.

Figure 1:
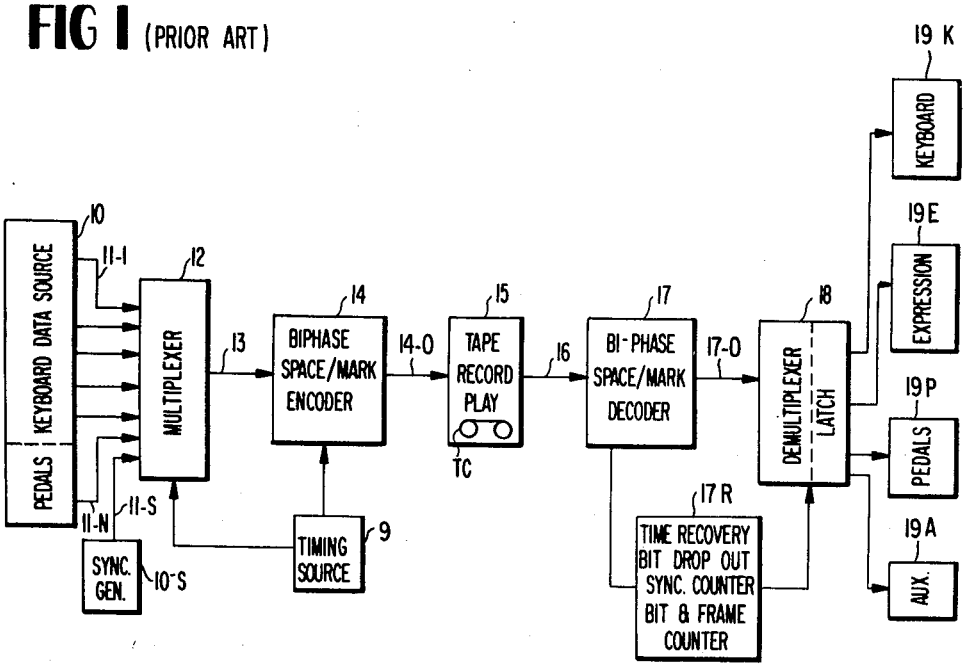
FIG 1 (PRIOR ART)
FIG. 1 is a diagrammatic block diagram of a prior art player piano recorder system.

Referring now to FIG. 1, the keyboard of a piano (not shown) is designated by the numeral 10 as a keyboard data source. It could be any musical keyboard instrument, such as a harpsichord, carillon, organ, piano, etc. and each output or switch actuation is indicated by a single line 11-1 through 11-N, the number of such output lines corresponding to the number of key switch actuations to be sensed and recorded, for example, 80 keys for the keys for notes 4–84, the notes at each extreme end of the keyboard not being recorded. These notes could, of course, if desired, be recorded. In addition, the "sustain" and "soft" pedals may be equipped with switches and the actuations of these switches sensed in the same way. Multiplexer 12, which is supplied by timing pulses from a timing source 9 scans or looks at each individual line 11-1 . . . 11-N in a timed sequence which constitutes a frame. Thus, the key switches, the sustain and soft pedal actuations are sensed by the digital multiplexer 12, one at a time, and in a generally sequential fashion. If no transpositions are contemplated, it is not necessary that they be sequentially examined, they may in this case be looked at or scanned in groups in any fashion or order, the only criteria being that the position of the particular switch in its scan time be maintained in the entire system. FIG. *2a* illustrates the bit assignment chart for 88 keys of the piano, and as intimated above, only notes 4 through 84 need be utilized for accurate and satisfactory reproduction of the music being played, although the entire keyboard may obviously be utilized. As illustrated in FIG. *2a,* bit positions 105 through 109 and bit positions 111 through 115 are the positions in each frame of data which are assigned to record the bass and treble intensities, and this may be done in the case of an original rendition by an artist by detecting the intensity (disregarding delay) of the note when it reaches its maximum sound by way of a microphone, and coding that intensity level for recording in the bass group of bit assignments 105–109, or in the treble group of bit assignments 111–115. Instead of sensing by way of a microphone the intensity of the notes as played, the intensity may be detected by acceleration sensing devices or other forms of transducers used to measure the force with which a key is struck by the artist and this data converted to binary form as the expression data for recording on tape in the bit positions 105–109 and 111–115. However, in accordance with the present invention, the expression information is prerecorded on the rolls and as will be discussed more fully hereinafter, the invention permits the variations in split due to the different sources to be accommodated by the system.

Referring again to FIG. 1, a synchronizing generator 10-S which generates the sync word shown in bit positions 121–128, supplies the sync word on lines 11-S to the multiplexer. The pedal controls for the sustain pedal and the soft pedal are recorded in bit positions 117 and 118 and are supplied on lines 11-N to the multiplexer. It is noted that there are fourteen un-assigned bits and two of these are used in accordance with the present invention and described more fully hereinafter. The output from the multiplexer on line 13 is supplied to an encoder 14, which, preferably, is a bi-phase space/mark encoder. The output of the encoder on line 14-0 is supplied to a tape recorder and playback unit 15 which records the encoded data on line 14 on a magnetic tape cassette TC. The information which is recorded on the magnetic tape TC set are serial frames of data which have the bit assignments shown in FIG. *2a* (keeping in mind that bit positions 1–3 and 85–88 need not be used).

During playback, the tape cassette TC is placed in the tape record playback unit 15 and the encoded data appears on the output of the read head and is fed through conventional correcting networks and amplifiers to recover the digital signal which appears on output line 16. This signal has included therein the clock data as part of the encoded signal when this clock signal is recovered and used, along with other information not here relevant, in time recovery circuit 17R and applied to the demultiplexer and latch circuit 18. In this prior art unit, the data from the decoder 17 is supplied on output lines 17-0 to the demultiplexer unit 18 which distributes the data to the appropriate control channels in the storage and solenoid actuator circuits 19K, for the keyboard data, 19E for the expression data, 19P for the pedal data, and 19A for auxiliary data which may be any one of the fourteen unassigned bits shown in FIG. 2. It should be noted at this point that several of the unassigned bits in this category will be utilized in accordance with the present invention.

Referring now to FIG. 3, a conventional player piano roll 30 having conventional perforations 31 or other notes signifying physical manifestation thereon (such as light transparencies, or reflections, contrasts such as black spots and the like) are moved past a transducer unit 32 by means of a constant paper drive (not shown) from a supply roller 34 to a take-up roller 35. Transducer 32, in its most simply form, be constituted by feeler switches which feel the presence or absence of a hole. They may be pneumatically operated switches where a supply of air is used to sense the presence or absence of a hole and operate a switch in response thereto. On the other hand, they may be phototransistors which sense the differential change in light projected through the roll according to the presence or absence of a hole or the presence or absence of an opaque portion of the roll.

The signals are applied as a plurality of parrallel data streams to a pulse stretcher 38, there being a pulse stretcher 38 associated with each transducer 32, so that the electrical signal issuing from the pulse stretchers 38 are the full equivalent of the electrical pulses produced by the key switch actuations during the normal playing of a piano equipped with such key switch actuators. In addition to the holes, etc. 31 which signify notes, a further group of holes, etc. 39 correspond to the bass and treble intensity levels assigned to bit positions 105–109 and 111–115 respectively of FIG. *2a*. Other holes, etc., not shown, may be used to carry other control information for the player piano. The holes, etc. or other physical manifestations of this expression information are simply diagrammatically shown on the roll 30, they may be located in other positions thereon, but are associated with different groups of the notes and, as indicated above, one source requires the split between the notes to be between notes 43 and 44, whereas another requires the split to be between 44 and 45, and still another requires the split to be between notes 46 and 47, in the format of the instruments utilizing such different player piano rolls. However, the notes, all of which are on the parallel tracks of information on the roll 30 to provide the plurality of parallel data streams, are scanned in the sequence illustrated in the bit chart assignment of FIG. *2a*. Other scanning sequences may be utilized, if desired. Thus, the note and expression manifestations of holes, etc. 31 and holes, etc. 39 are detected or sensed by transducers 32, there being one transducer 32 for each track or data stream on roll 30, and roll 30 is moved past the transducers at the standard playing rate. Since the data is in digital form it may be stored in a large memory and for later production of magnetic tapes, with the rate information. However, it is intended that the present invention encompass the movement of the roll 30 at rates other than the standard playback rate for such player piano rolls. The signals from the pulse stretchers 38 are then scanned in the multiplexing fashion in the same way and sense as multiplexer 12 of the prior art, along with the scanning of the synch generator words from sync generator 10-S. Since the data is in digital form it may be stored in a large memory for later production of magnetic tapes, or as an easily accessible library for coin operated player pianos, either before or after stretching.

As noted earlier, and as shown in FIG. *2a*, there are fourteen un-assigned bits and, in the embodiment of the invention disclosed herein, two of these un-assigned bits are utilized to record control signals which are code words identifying the particular source or type of roll 30 and whether the split for the bass and treble expression points is to be between notes 43 and 44, or between notes 44 and 45, or between notes 46 and 47. Thus, a pair of switches 50A and 50B are provided for the formating operator who enters information identifying the roll that is being transcribed from roll form 30 to magnetic tape. There are four possible "code words" which can be generated by switches 50A and 50B and these are illustrated in the truth table functions shown in FIG. 6 as illustrated diagrammatically on the section of tape shown in FIG. *2b*, the serial sequence of binary data bits of the bit assignment chart is recorded on the magnetic tape, have the bit assignment shown in FIG. *2a*. Bits 1 through 88 carrying the musical note manifestations and the digital code words for generated by switches **50*a* and 50*b* are recorded in bit positions 119 and 120** (FIG. *2a*). Referring now to FIG. 5, the expression information recorded on bit positions 105–109 and 111–115 of the bit assignment chart in FIG. *2a*, is delivered to expression circuit 19E which is shown in block diagram form in FIG. 4.

In general, these ten bits of information are used as control signals for controlling the width of pulses in a sequence of pulses which are used for selectively energizing the activating instrumentalities of the keyboard instrument. As disclosed and claimed in U.S. Ser. No. 680,996, filed Apr. 28, 1976, the binary bits are weighted and used to modulate the width of pulses supplied to selected solenoid in either the bass half or the treble half of the keyboard, and as shown in the prior art unit, a low frequency (200 Hz) oscillator 70 supplies its output pulses to a pair of pulse width modulatable one shot multivibrators 71 and 72 for the bass and treble keys, respectively. The pulses from oscillator 70 have their minimum width set by a variable resistor 73 which thus sets the minimum width of the pulses from multivibrator 71 and 72. Each multivibrator 71 and 72 thus has its timing set by capacitors 74 and 75, respectively, in conjunction with resistors 76–80 for the bass volume, and resistors 81–85 for the treble volume. Combinations of resistors 76–80 and combinations of resistors 81–85 are selected by the information in the bit positions 105–109 or 111–115 of FIG. 2*a* which have been stored in expression and pedal control latch circuits U-20 and U-21. This stores the treble and bass expression bits in the latch circuits along with the soft and sustain pedal controls. These stored bits are used to vary the number of resistors 76–80 and 81–85 (which are essentially binary weighted) in circuit with the timing capacitors 74 and 75 to thereby vary the charging rate of the capacitors and hence the width of pulses for the bass and treble effects as supplied to the solenoids. These bass effect pulse width pulses are supplied to the group of transistor driver AND gates DGB for the bass notes and solenoid control as a second input thereto and the treble effect pulse width modulated pulses are supplied to driver transistor AND gates DGT for the treble note solenoid controls. Thus, the control signals on the bases of solenoid driver transistors $Q_1$–$Q_{16}$ are varied in width to thereby vary the energy delivered to the solenoid S for the bass and treble notes of the piano keyboard. Inductive spike diodes $CR_1$–$CR_{16}$ are connected in shunt with the solenoid winding. In accordance with the present invention, as shown in FIG. 7 of the playback driver of the prior art, as modified in accordance with the present invention, the lines to notes 44, 45 and 46 are disconnected and connected to points 3 and 4 as shown in FIG. 5.

Figure 2B:
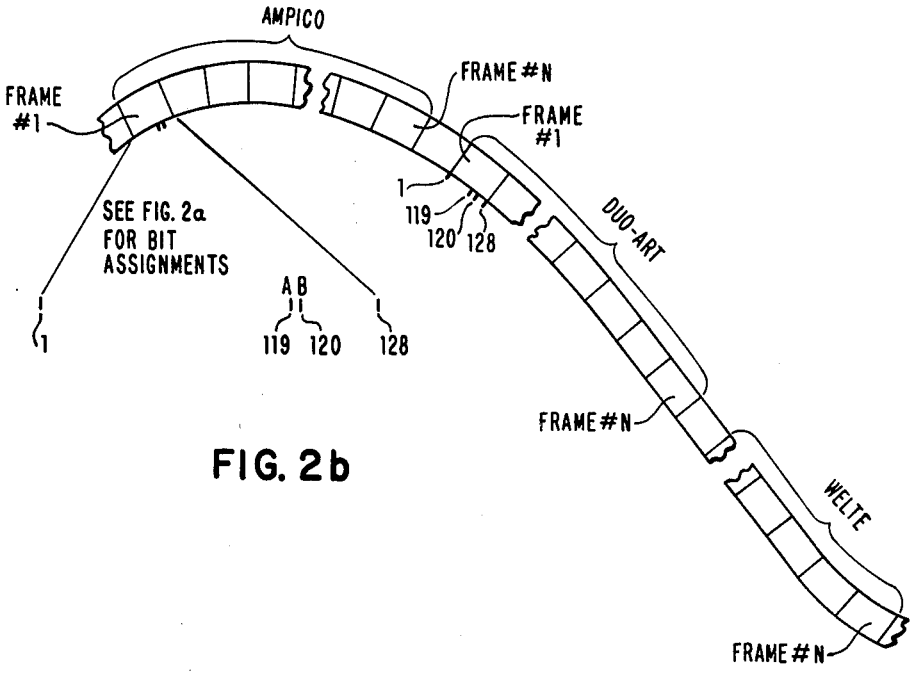

Referring now to FIG. 5, the code word information identifying the particular type of music source (Welte, Duo-Art, or Ampico, as well as any others) are supplied to the inputs of the OR circuit shown in FIG. 5. The OR circuit is constituted by NOR gates N-1 to N-6 and NOR gates N-7 and N-8 connected as insolating inverters. The bass expression is simulated at output terminal 2 of the logic director circuit of FIG. 5, while the treble expression is simulated at output terminal 1. The control bits or "code words" which identify whether the roll as a Welte, Duo-Art, or Ampico or whether it is a tape which has been made by way of some other source and/or the playing of the piano and recording thereon by use of the recorder unit described in connection with the block diagram of FIG. 1, and, in the present case, they are position assigned to bit positions 119 and 120 (FIG. 2*a*). As shown in the truth table (FIG. 6), if A and B are zero, e.g, there are no bits or ones in bit positions 119 and 120 of FIG. 2*a*, the split is between notes 44 and 45 so the bass expression information on line 2 is supplied to all notes from 4 through 44. If A bit is zero and the B bit is one (there is a zero at bit position 119 and a one at bit position 120) the split is between notes 43 and 44 so that the expression bits which are the pulse width modulated pulses from the expression circuit are delivered at terminals 1, 3, and 4 to the notes from 44 through 84. If A bit is a one and the B bit is a zero (bit position 119 has a one stored therein and bit position 120 has a zero stored therein) the split is between notes 46 and 47 so that the bass information on line 2 is supplied to all solenoids for the playing of the notes 4 through 46 and the treble information is supplied to the solenoids for playing notes 47–84. FIG. 2*b* shows control bits or code words in bit positions 119 and 120 which identify the particular format of the player piano roll of music transcribed as being Duo-Art, Welte, or Ampico and, as indicated above, any other format of player piano roll music could be recorded in the same way and assigned its unique code so that during playback the code is recognized and the expression properly applied. If both A and B are one, this is information that the split is not important so that it is not used. However, if there are other rolls which it is desired to encode, they could be used to be assigned to this particular code.

While it has been disclosed that the code words identifying the particular source of the music and thereby the split for the expression between the notes are recorded in each frame of data at bit positions 119 and 120, in the present embodiment any pair of vacant bit positions could be used for this purpose. Moreover, instead of recording the code word in every frame, it could be recorded in the initial frames, if desired, and a memory provided to remember this code word and thereby supply same to the input to the decoding logic network shown in FIG. 5.

Thus, the invention permits the universal adaptation of any player piano rolls for use in electronic player pianos and other keyboard instruments while preserving the expression information as originally intended by the producers of those systems. Thus, the electronic player piano is now made universally and dynamically adaptable to play any previously recorded roll music which has been transcribed and formated in accordance with the principles of the present invention.

While the invention has been described and illustrated by reference to a preferred embodiment, it is to be understood that various changes and modifications may be made in the invention by those skilled in the art without departing from the inventive concept, the scope of which is determined by the appended claims in light of the prior art and the specification contained herein.

What is claimed is:

1. In a method of digitally recording musical data on magnetic tape for the recreation of musical performances by a plurality of electronically controlled musical note producing instruments, said musical performances having been previously recorded on player piano rolls as a plurality of parallel data streams in various formats and wherein the streams of parallel data are scanned in sequence for producing, for each data stream, an electrical signal corresponding to the presence or absence of a note to be played in the recreation of said musical performance along with a plurality of parallel data streams carrying expression data bits which vary according to said various formats, said scanning of said streams of parallel data and producing electrical signals being in a sequence to produce a serial musical data stream divided into multiplexed frames of musical data cells, there being at least one data cell in each frame for each one of said plurality of parallel data streams the improvement comprising providing at least one further group of data cells in said serial data stream for carrying digital code words which identify the format of the musical data as recorded on said player piano roll, generating a code word unique to each of said various formats and inserting said code words into said data cells for carrying code words, and magnetically recording said serial musical data streams divided into multiplexed frames of musical data cells on a single channel of a magnetic tape.

2. A method of recreating musical performances recorded on a magnetic tape by the method defined in claim 1 comprising reading said serial data stream of serially recorded data in the recreation of each of said musical performances, detecting the code word in said data cells carrying said code words, and controlling the application of said expression data bits to selected ones of said musical note producing instruments according to the format of the musical data identified by the detected code words.

3. Apparatus for re-creating magnetic tape recorded musical presentations of a keyboard instrument by actuation of the keys of a further keyboard instrument and to re-create expression effects thereof, said keyboard instrument having treble and bass keys comprising:

a magnetic tape playback unit for playing a magnetic tape having a serial sequence of binary bits recorded thereon in frames of data bits representing each said musical presentation, at least one of the data bits in said frames of data bits constituting a code word for identifying the position of the split between the treble and bass keys of said keyboard instrument, and means responsive to each said code word for selectively varying the keys of said re-creating instrument which receive said expression bits.

4. In a player piano roll music to magnetic tape transcriber said player piano roll music having expression information in varying format, said transcriber having means for transducing music note manifestations on said player piano roll music to digital signals and time division multiplexing same to a serial format in sequential time frames of digital data and recording said sequential time frames of digital data on magnetic tape, the improvement comprising:

means for entering a digital code word to a selected position in at least the first of said sequential time frames of digital data, said code word identifying the particular format of each roll music transcribed.

5. The invention defined in claim 4 wherein said digital code word is entered into substantially every said sequential time frame of digital data.

6. In a method of transcribing player piano music note bearing members on which the music note manifestations are carried to magnetic tape wherein the musical note manifestations carried on said player piano music note carrying members are transduced to electrical signals, said electrical signals are scanned and time division multiplexed into a serial format in sequential time frames of digital data and then recorded on magnetic tape and wherein the format of musical note manifestation on said player piano music note bearing members can vary from member to member, the improvement comprising:

for each music note bearing member recorded on said tape entering a digital code word to a selected position in at least the first of said time frames said code word identifying the particular format of the musical note manifestations on the player piano music note bearing member.

7. The method defined in claim 6, wherein said code word is entered into substantially every frame of said time division multiplexed data.

8. A magnetic tape as produced by the method defined in claim 6 wherein there are a plurality of different code words recorded on said magnetic tape, there being at least one recorded code word for each particular format of musical note manifestations on the player piano note bearing member.

9. A magnetic tape for operating an electronic player piano and to re-create a sequence of different musical presentations, said tape having a serial sequence of time division multiplexed frames of data, there being a sequence for each musical presentation, each frame of data containing a section for recording data bits for controlling the playing of the notes of the piano, a section for recording data bits for bass and treble expression controls, a section containing synchronizing word bits, said electronic player piano having a keyboard controlled by said magnetic tape, the improvement comprising:

a further section in at least the first of said time division multiplexed frames of data and a control word recorded in said further section for each said musical presentation for controlling the bass and treble sections of the keyboard of said piano to which said expression bits are applied.

* * * * *